US005230823A

United States Patent [19]

Wise et al.

[11] Patent Number: 5,230,823

[45] Date of Patent: Jul. 27, 1993

[54] LIGHT-DUTY LIQUID OR GEL DISHWASHING DETERGENT COMPOSITION CONTAINING AN ALKYL ETHOXY CARBOXYLATE SURFACTANT

[75] Inventors: Rodney M. Wise; Thomas A. Cripe, both of Cincinnati, Ohio

[73] Assignee: The Procter & Gamble Company, Cincinnati, Ohio

[21] Appl. No.: 807,770

[22] Filed: Dec. 9, 1991

Related U.S. Application Data

[63] Continuation of Ser. No. 516,292, May 4, 1990, abandoned, which is a continuation-in-part of Ser. No. 354,967, May 22, 1989, abandoned.

[51] Int. Cl.[5] ..... C11D 1/66; C11D 3/075; C11D 1/72; C11D 1/74

[52] U.S. Cl. ..... 252/174.21; 252/174.22; 252/DIG. 1; 252/DIG. 14

[58] Field of Search ..... 252/89.1, 108, 132, 252/174.21, 174.22, 173, DIG. 14, DIG. 1

[56] References Cited

U.S. PATENT DOCUMENTS

| | | | |
|---|---|---|---|
| 2,623,900 | 12/1952 | Hofer | 562/470 |
| 3,038,862 | 6/1962 | deJong | 252/548 |
| 3,992,443 | 11/1976 | Springmann | 562/587 |
| 4,098,818 | 7/1978 | Krummel et al. | 252/170 |
| 4,129,515 | 12/1978 | Foster | 252/117 |
| 4,214,101 | 7/1980 | Miya | 562/421 |
| 4,223,163 | 9/1980 | Guilloty | 568/618 |
| 4,226,736 | 10/1980 | Bush et al. | 252/135 |
| 4,233,460 | 11/1980 | Willis | 562/537 |
| 4,348,509 | 9/1982 | Sanders | 562/538 |
| 4,435,317 | 3/1984 | Gerritsen et al. | 252/547 |
| 4,615,819 | 10/1986 | Leng et al. | 252/110 |
| 4,736,756 | 4/1988 | Grollier | 132/7 |
| 4,759,875 | 7/1988 | Hart | 252/551 |

FOREIGN PATENT DOCUMENTS

| | | |
|---|---|---|
| 0072600 | 2/1983 | European Pat. Off. . |
| 0154380 | 9/1985 | European Pat. Off. . |
| 0304763 | 3/1989 | European Pat. Off. . |
| 2348323 | 4/1975 | Fed. Rep. of Germany . |
| 48-60706 | 8/1973 | Japan . |
| 48-64102 | 9/1973 | Japan . |
| 49-37908 | 4/1974 | Japan . |
| 5024215 | 3/1975 | Japan . |
| 55-144099 | 11/1980 | Japan . |
| 57-202391 | 12/1982 | Japan . |
| 61-21199 | 1/1986 | Japan . |
| 2038506 | 3/1989 | Japan . |
| 456517 | 11/1936 | United Kingdom . |
| 027481 | 4/1966 | United Kingdom . |
| 1468856 | 3/1977 | United Kingdom . |
| 1475064 | 6/1977 | United Kingdom . |
| 2197338A | 5/1988 | United Kingdom . |

OTHER PUBLICATIONS

U.S.S.N. 354,968, Cripe, filed May 22, 1989.

*Primary Examiner*—Paul Lieberman
*Assistant Examiner*—David A. Zarneke
*Attorney, Agent, or Firm*—Mary P. McMahon; Fernando A. Borrego; Donald E. Hasse

[57] ABSTRACT

A light-duty liquid or gel dishwashing detergent composition containing an alkyl ethoxy carboxylate surfactant and little or no alcohol ethoxylate and soap by-product contaminants. The compositions exhibit good grease removal while manifesting mildness to the skin. A preferred type of dishwashing detergent composition is in the liquid form. High pH and magnesium ion containing versions of the compositions increase grease removal properties while maintaining mildness.

28 Claims, No Drawings

LIGHT-DUTY LIQUID OR GEL DISHWASHING DETERGENT COMPOSITION CONTAINING AN ALKYL ETHOXY CARBOXYLATE SURFACTANT

CROSS REFERENCE TO RELATED CASES

This is a continuation of application Ser. No. 516,292, filed on May 4, 1990, which is now abandoned which is a continuation-in-part of our copending application, Ser. No. 354,967, filed May 22, 1989, which application is now abandoned.

TECHNICAL FIELD

The present invention relates to light-duty liquid or gel dishwashing detergent compositions containing alkyl ethoxy carboxylate surfactants (alternatively labeled alkyl polyethoxy carboxy methylates, alkyl polyethoxy acetates, alkyl polyether carboxylates, etc.) of the type disclosed in U.S. Pat. Nos. 2,183,853; 2,653,972; 3,003,954; 3,038,862; 3,741,911; and 3,941,710; British Pat. Nos. 456,517 and 1,169,496; Canadian Pat. No. 912,395; French Pat. Nos. 2,014,084 and 2,042,793; Netherland Patent Application Nos. 7,201,735-Q and 7,406,336; and Japanese Patent Application Nos. 96,579/71 and 99,331/71.

BACKGROUND ART

There has been considerable demand for light-duty liquid or gel dishwashing detergents capable of providing good grease removal. These compositions are well known in the art and are described, for example, in U.S. Pat. Nos. 4,316,824 (Pancheri), 4,681,704 (Bernardino et al.), 4,133,779 (Hellyer et al.), and 4,615,819 (Leng et al). These compositions, although being good grease and soil cleaners, can be harsh to the skin under certain conditions, particularly when used during the dry winter months.

Likewise, the art is replete with detergent compositions that are mild to the skin. These mild compositions often contain sulfates of highly ethoxylated alcohols. See, for example, U.S. Pat. No. 3,743,233, Rose and Thiele. Betaines have also been suggested for use in improving mildness of a liquid dishwashing composition. See, for example, U.S. Pat. No. 4,555,360 (Bissett et al). Alkyl ethoxy carboxylates are also known as mild surfactants for use in liquid detergent compositions. See Japanese Patent Applications 48-60706 and 48-64102. These alkyl ethoxy carboxylate surfactants, however ,have been described as being poor in their grease cutting ability and require the use of other surfactants to achieve the desired cleaning.

Rarely have these two important features of mildness and grease cutting ability been incorporated in one product. It is generally thought that one must be sacrificed for the benefit of the other. It is therefore an object of this invention to provide a detergent composition that exhibits good grease removal while manifesting mildness to the skin.

SUMMARY OF THE INVENTION

The present invention relates to a light-duty liquid or gel, preferably liquid, dishwashing detergent composition comprising from about 5% to 70% of a surfactant mixture comprising:

(a) from about 80% to 100% of alkyl ethoxy carboxylates of the formula:

$$RO(CH_2CH_2O)_xCH_2COO^-M^+$$

wherein R is a $C_{12}$ to $C_{16}$ alkyl group, x ranges from 0 to about 10 and the ethoxylate distribution is such that, on a weight basis, the amount of material where x is 0 is less than about 20% and the amount of material where x is greater than 7 is less than about 25%, the average x is from about 2 to 4 when the average R is $C_{13}$ or less, and the average x is from about 3 to 6 when the average R is greater than $C_{13}$, and M is a cation;

(b) from 0% to about 10% of alcohol ethoxylates of the formula:

$$RO(CH_2CH_2O)_xH$$

wherein R is a $C_{12}$ to $C_{16}$ alkyl group and x ranges from 0 to about 10 and the average x is less than about 6; and (c) from 0% to about 10% of soaps of the formula:

$$RCOO^-M^+$$

wherein R is a $C_{11}$ to $C_{15}$ alkyl group and M is a cation; wherein a 10% by weight aqueous solution of said composition has a pH from about 7 to 11.

DETAILED DESCRIPTION OF THE INVENTION

The light-duty liquid or gel, preferably liquid, dishwashing detergent compositions of the present invention contain a surfactant mixture comprising a major amount of an alkyl ethoxy carboxylate surfactant and little or no alcohol ethoxylate and soap by-product contaminants. These and other complementary optional ingredients typically found in liquid or gel dishwashing compositions are set forth below.

Alkyl Ethoxy Carboxylate-Containing Surfactant Mixture

The liquid compositions of this invention contain from about 5% to 50% by weight, preferably from about 10% to 40%, most preferably from about 12% to 30%, of a surfactant mixture restricted in the levels of contaminants. Gel compositions of this invention contain from about 20% to about 70%, preferably from about 25% to about 45%, most preferably from about 28% to about 35%, of the surfactant mixture.

The surfactant mixture contains from about 80% to 100%, preferably from about 85% to 95%, most preferably from about 90% to 95%, of alkyl ethoxy carboxylates of the generic formula $RO(CH_2CH_2O)_xCH_2COO^-M^+$ wherein R is a $C_{12}$ to $C_{16}$ alkyl group, x ranges from 0 to about 10, and the ethoxylate distribution is such that, on a weight basis, the amount of material where x is 0 is less than about 20%, preferably less than about 15%, most preferably less than about 10%, and the amount of material where x is greater than 7 is less than about 25%, preferably less than about 15%, most preferably less than about 10%, the average x is from about 2 to 4 when the average R is $C_{13}$ or less, and the average x is from about 3 to 6 When the average R is greater than $C_{13}$, and M is a cation, preferably chosen from alkali metal, alkaline earth metal, ammonium, mono-, di-, and tri-ethanol-ammonium, most preferably from sodium, potassium, ammonium, and mixtures thereof with magnesium ions. The preferred alkyl ethoxy carboxylates are those where R is a $C_{12}$ to $C_{14}$ alkyl group.

Suitable alcohol precursors of the alkyl ethoxy carboxylates of this invention are primary aliphatic alcohols containing from about 12 to about 16 carbon atoms. Other suitable primary aliphatic alcohols are the linear primary alcohols obtained from the hydrogenation of vegetable or animal fatty acids such as coconut, palm kernel, and tallow fatty acids or by ethylene build up reactions and subsequent hydrolysis as in the Ziegler type processes. Preferred alcohols are n-octyl, n-nonyl, n-decyl, n-undecyl, n-dodecyl, n-tridecyl, n-tetradecyl, n-pentadecyl, and n-hexadecyl. Other suitable alcohol precursors include primary alcohols having a proportion of branching on the beta or 2-carbon atoms wherein the alkyl branch contains from 1 to 4 carbon atoms. In such alcohols at least 30% of the alcohol of each specific chain length is desirably linear and the branching preferably comprises about 50% of methyl groups with smaller amounts of ethyl, propyl and butyl groups. These alcohols are conveniently produced by reaction of linear olefins having from about 11 to 17 carbon atoms with carbon monoxide and hydrogen. Both linear and branched chain alcohols are formed by these processes and the mixtures can either be used as such or can be separated into individual components and then recombined to give the desired blend.

Typical processes for producing "Oxo" halides which are then used to prepare alcohols are disclosed in U.S. Pat. Nos. 2,564,456 and 2,587,858 and the direct hydroformylation of olefins to give alcohols is disclosed in U.S. Pat. Nos. 2,504,682 and 1,581,988. All of these patents are incorporated herein by reference.

The equivalent secondary alcohols can also be used. It will be apparent that by using a single chain length olefin as starting material, a corresponding single chain length alcohol will result, but it is generally more economical to utilize mixtures of olefins having a spread of carbon chain length around the desired mean. This will of course, provide a mixture of alcohols having the same distribution of chain lengths around the mean.

Primary aliphatic alcohols derived from vegetable oils and fats and from other petroleum feed stocks having alkyl or alkylene groups as part of their structure will also contain a range of chain lengths. Since the range of chain lengths is $C_8$–$C_{20}$ and beyond, it is therefore normal practice to separate the product from such feed stocks into different chain length ranges which are chosen with reference to their ultimate use.

The desired average ethoxy chain length on the alcohol ethoxylate can be obtained by using a catalyzed ethoxylation process, wherein the molar amount of ethylene oxide reacted with each equivalent of fatty alcohol will correspond to the average number of ethoxy groups on the alcohol ethoxylated. The addition of ethylene oxide to alkanols is known to be promoted by a catalyst, most conventionally a catalyst of either strongly acidic or strongly basic character. Suitable basic catalysts are the basic salts of the alkali metals of Group I of the Periodic Table, e.g., sodium, potassium, rubidium, and cesium, and the basic salts of certain of the alkaline earth metals of Group II of the Periodic Table, e.g., calcium, strontium, barium, and in some cases magnesium. Suitable acidic catalysts include, broadly, the Lewis acid of Friedel-Crafts catalysts. Specific examples of these catalysts are the fluorides, chlorides, and bromides of boron, antimony, tungsten, iron, nickel, zinc, tin, aluminum, titanium, and molybdenum. The use of complexes of such halides with, for example, alcohols, ethers, carboxylic acids, and amines have also been reported. Still other examples of known acidic alkoxylation catalysts are sulfuric and phosphoric acids; perchloric acid and the perchlorates of magnesium, calcium, manganese, nickel, and zinc; metals oxalates, sulfates, phosphates, carboxylates, and acetates; alkali metal fluoroborates, zinc titanate; and metal salts of benzene sulfonic acid. The type of catalyst used will determine the distribution of the range of ethoxy groups. Stronger catalysts will result in a very tight or narrow distribution of the ethoxy groups around the mean. Weaker catalysts will result in a wider distribution.

The surfactant mixture also contains from 0% to about 10%, preferably less than about 8%, most preferably less than about 5%, of alcohol ethoxylates of the formula $RO(CH_2CH_2O)_xH$ wherein R is a $C_{12}$ to $C_{16}$ alkyl group and x ranges from 0 to about 10 and the average x is less than 6. The surfactant mixture also contains 0% to about 10%, preferably less than about 8%, most preferably less than about 5%, of soaps of the formula $RCOO^-M^+$ wherein R is a $C_{11}$ to $C_{15}$ alkyl group and M is a cation as described above.

The uncarboxylated alcohol ethoxylates noted above are a detriment to the alkyl ethoxy carboxylate surfactant mixture, especially with respect to the performance benefits provided therefrom. Therefore, it is critical that the alkyl ethoxy carboxylate-containing surfactant mixture used in this invention contain less than about 10% by weight of the alcohol ethoxylates they are derived from. Although commercially available alkyl ethoxy carboxylates contain 10% or more of alcohol ethoxylates, there are known routes to obtain the desired high purity alkyl ethoxy carboxylates. For example, unreacted alcohol ethoxylates can be removed by steam distillation, U.S. Pat. No. 4,098,818 (Example I), or by recrystallization of the alkyl ethoxy carboxylate, British Pat. No. 1,027,481 (Example 1). Other routes to the desired carboxylates are the reaction of sodium hydroxide or sodium metal and monochloracetic acid, or its salt, with alcohol ethoxylates under special pressure and temperature combinations, as described in U.S. Pat. Nos. 3,992,443 and 4,098,818; and Japanese Patent Application No. 50-24215, all incorporated herein by reference.

Alternatively, a hindered base, such as potassium tert-butoxide can replace the sodium hydroxide in the above cited patents, thus yielding high purity alkyl ethoxy carboxylates with less stringent temperature and pressure requirements. Specifically, a hindered base of the formula $RO^-M^+$, constituting generally an alkyl group, a reactive oxygen center, and a cation is used. The structure of this hindered base is secondary or tertiary and contains a non-linear alkyl group with at least one site of branching within 3 carbon atoms of the reactive center, the oxygen atom, and an alkali metal or alkaline earth metal cation. The process comprises reacting the alcohol ethoxylates with the hindered base described above and either anhydrous chloroacetic acid, at a molar ratio of the hindered base to the anhydrous chloroacetic acid of 2:1, or an alkali metal salt or alkaline earth metal salt of anhydrous chloroacetic acid, at a molar ratio of the hindered base to the alkali metal salt or alkaline earth metal salt of chloroacetic acid of 1:1, wherein the molar ratio of the ethoxylated fatty alcohol to the anhydrous chloroacetic acid or the alkali metal salt or alkaline earth metal salt thereof is from about 1:0.7 to about 1:1.25, the temperature is from about 20° to 140° C., and the pressure is from about 1 to 760 mm Hg.

Other routes to high purity alkyl ethoxy carboxylates are the reaction of alcohol ethoxylate with oxygen in the presence of platinum, palladium, or other noble metals, as disclosed in U.S. Pat. No. 4,223,460 (Example 1-7); U.S. Pat. No. 4,214,101 (Example 1); U.S. Pat. No. 4,348,509; German Patent No. 3,446,561; and Japanese Patent Application No. 62,198,641. One of the by-products of such reactions is soap, which should be limited, as described above, to avoid adversely affecting the cleaning and mildness advantages provided by the present compositions. This can be accomplished by using alcohol ethoxylate feedstock containing low levels of unethoxylated fatty alcohol and by selecting catalysts that preferentially oxidize the terminal methylene in the alcohol ethoxylate, at least about 90% of the time, preferably at least about 95% of the time. Oxidation of non-terminal methylene groups in the alcohol ethoxylate will generate soap from ethoxylated fatty alcohol components.

The compositions of this invention have a pH from about 7 to 11, preferably determined as the pH of a 10% by weight aqueous solution with a pH meter. The preferred detergent compositions have a pH from about 8 to 10.5 and most preferably from about 8.5 to 10. Traditionally, liquid dishwashing compositions have a pH of about 7. It has been found for detergent compositions of this invention that a more alkaline pH of about 9 greatly improves the grease cleaning as compared to a product with a pH of 7. This cleaning benefit appears to be unique to compositions containing the present alkyl ethoxy carboxylates. Surprisingly, the compositions of this invention are also more mild to hands at this alkaline pH than at a pH of 7.

If a composition with a pH greater than 7 is to be most effective in improving performance, it should contain a buffering agent capable of maintaining the alkaline pH in the composition and in dilute solutions, i.e., about 0.1% to 0.2% by weight aqueous solution, of the composition. The pKa value of this buffering agent should be about 0.5 to 1.0 pH units below the desired pH value of the composition (determined as described above).

Dishwashing compositions of the invention will be subjected to acidic stresses created by food soils when put to use, i.e., diluted and applied to soiled dishes. To maintain the performance benefits of the compositions in use, a buffering agent having a pKa value about 0.5 to 1.0 pH units below the desired pH value should be present therein. Under these conditions the buffering agent most effectively controls the pH while using the least amount thereof.

The buffering agent may be an active detergent in its own right, or it may be a low molecular weight, organic or inorganic material that is used in this composition solely for maintaining an alkaline pH. Preferred buffering agents for compositions of this invention are nitrogen-containing materials. Some examples are glycine or other amino acids or lower alcohol amines like mono-, di-, and tri-ethanolamine. Other preferred nitrogen-containing buffering agents are 2-amino-2-ethyl-1,3-propanediol, tris-(hydroxymethyl)aminomethane, and disodium glutamate. Boric acid is also preferred. These buffering agents are typically present at a level of from about 0.1% to 10% by weight, preferably from about 1% to 7%, most preferably from about 1.5% to 5%.

The cations for the alkyl ethoxy carboxylates herein can be alkali metals, alkaline earth metals, ammonium, and lower alkanol ammonium ions. The source of cations for the alkyl ethoxy carboxylates come from neutralization of the alky ethoxy carboxylic acid and from additional ingredients, e.g., performance enhancing divalent ion-containing salts.

Preferred cations for compositions of the invention are ammonium, sodium, and potassium. For compositions having a pH between about 7 and 8, ammonium is most preferred, but at pH levels above about 8, it is undesirable due to the release of small amounts of ammonia gas resulting from deprotonation of the ammonium ions in the composition.

For liquid compositions of the invention, potassium is preferred over sodium since it makes the compositions of the invention more resistant to precipitate formation at low temperatures and provides improved solubility to the composition. On the other hand, for gel compositions of the invention, sodium is preferred over potassium since it makes it easier to gel a composition. Mixtures of the cations may be present in any of the compositions of the invention.

Furthermore, it has been found that for the present alkyl ethoxy carboxylates the presence of divalent cations greatly improves the cleaning of greasy soils. This is especially true when the compositions are used in softened water that contains few divalent ions. Dishwashing liquid compositions that contain alkyl ethoxy carboxylates that do not conform to the narrow definition of this invention will be less benefited by the addition of divalent ions and, in many cases, will actually exhibit reduced cleaning performance upon the addition of divalent cations. It is believed that divalent ions increase the packing of the present alkyl ethoxy carboxylates at the oil/water interface, thereby reducing interfacial tension and improving grease cleaning.

Preferably, the divalent ions are added as a chloride or sulfate salt to compositions containing an alkali metal or ammonium salt of the alkyl ethoxy carboxylate, most preferably the sodium salt, after the composition has been neutralized with a strong base. The level of divalent ion in the composition is from 0% to about 1.5%, preferably from about 0.2% to 1%, most preferably from about 0.3% to 0.8%, by weight. Particularly preferred divalent ions are magnesium ions.

When both divalent ions and alkaline pH are combined with the surfactant mixture of this invention, grease cleaning is achieved that is superior to that obtained by either alkaline pH or divalent ions alone. Preferably, the divalent ion is magnesium, present in the composition at a level of from about 0.1% to 1%, most preferably from about 0.3% to 0.8%, by weight, while the pH is preferably from about 8 to 9.5 and most preferably from about 8.5 to 9.5. Compositions that contain higher levels of magnesium and have a pH much above about 9.5 are not preferred due to a tendency to form precipitates.

The amount of magnesium ions present in compositions of the invention will be dependent upon the amount of total anionic surfactant present therein, including the amount of alkyl ethoxy carboxylates. When magnesium ions are present in the compositions of this invention, the molar ratio of magnesium ions to total anionic surfactant is from about 0.25:1 to about 0.5:1 for compositions of the invention.

Co-Surfactants

The compositions of this invention preferably contain certain co-surfactants to aid in the foaming, detergency, and/or mildness.

Included in this category are several anionic surfactants commonly used in liquid or gel dishwashing detergents. The cations associated with these anionic surfactants can be the same as the cations described previously for the alkyl ethoxy carboxylates. Examples of anionic co-surfactants that are useful in the present invention are the following classes:

(1) Alkyl benzene sulfonates in which the alkyl group contains from 9 to 15 carbon atoms, preferably 11 to 14 carbon atoms in straight chain or branched chain configuration. An especially preferred linear alkyl benzene sulfonate contains about 12 carbon atoms. U.S. Pat. Nos. 2,220,099 and 2,477,383 describe these surfactants in detail.

(2) Alkyl sulfates obtained by sulfating an alcohol having 8 to 22 carbon atoms, preferably 12 to 16 carbon atoms. The alkyl sulfates have the formula $ROSO_3^-M^+$ where R is the $C_{8-22}$ alkyl group and M is a mono- and/or divalent cation.

(3) Paraffin sulfonates having 8 to 22 carbon atoms, preferably 12 to 16 carbon atoms, in the alkyl moiety. These surfactants are commercially available as Hostapur SAS from Hoechst Celanses.

(4) Olefin sulfonates having 8 to 22 carbon atoms, preferably 12 to 16 carbon atoms. U.S. Pat. No. 3,332,880 contains a description of suitable olefin sulfonates.

(5) Alkyl ether sulfates derived from ethoxylating an alcohol having 8 to 22 carbon atoms, preferably 12 to 16 carbon atoms, less than 30, preferably less than 12, moles of ethylene oxide. The alkyl ether sulfates having the formula:

$$RO(C_2H_4O)_xSO_3^-M^+$$

where R is the $C_{8-22}$ alkyl group, x is 1-30, and M is a mono- or divalent cation.

(6) Alkyl glyceryl ether sulfonates having 8 to 22 carbon atoms, preferably 12 to 16 carbon atoms, in the alkyl moiety.

(7) Dialkyl sulfosuccinates of the formula:

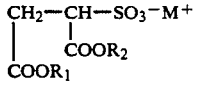

where each of $R_1$ and $R_2$, which may be the same or different, represents a straight chain or branched chain alkyl group having from about 4 to 10 carbon atoms ad more preferably from about 6 to 8 carbon atoms, and $M^+$ represents a mono-or divalent cation. A more complete description of suitable dialkyl sulfosuccinates can be found in GB 2,105,325 and GB 2,104,913.

(8) Fatty acid ester sulfonates of the formula:

$$R_1—CH(SO_3^{-M+})CO_2R_2$$

wherein $R_1$ is straight or branched alkyl from about $C_8$ to $C_{18}$, preferably $C_{12}$ to $C_{16}$, and $R_2$ is straight or branched alkyl from about $C_1$ to $C_6$, preferably primarily $C_1$, and $M^+$ represents a mono-or divalent cation.

(9) Mixtures thereof.

The above described anionic surfactants are all available commercially. It should be noted that although both dialkyl sulfosuccinates and fatty acid ester sulfonates will function well at neutral to slightly alkaline pH, they will not be chemically stable in a composition with pH much greater than about 8.5.

Other useful co-surfactants for use in the compositions are the nonionic fatty alkylpolyglucosides. These surfactants contain straight chain or branched chain $C_8$ to $C_{15}$, preferably from about $C_{12}$ to $C_{14}$, alkyl groups and have an average of from about 1 to 5 glucose units, with an average of 1 to 2 glucose units being most preferred. U.S. Pat. Nos. 4,393,203 and 4,732,704, incorporated by reference, describe these surfactants.

The co-surfactants for the compositions of this invention can also contain mixtures of anionic surfactants with alkyl polyglucosides. The co-surfactants are present in the composition at a level of from 0% to about 35% by weight, preferably from about 5% to 25%, and most preferably from about 7% to 20%.

Suds Booster

Another component which may be included in the composition of this invention is a suds stabilizing surfactant (suds booster) at a level of less than about 15%, preferably from about 0.5% to 12%, more preferably from about 1% to 10%. Optional suds stabilizing surfactants operable in the instant composition are of five basic types—betaines, ethylene oxide condensates, fatty acid amides, amine oxide semi-polar nonionics, and cationic surfactants.

The composition of this invention can contain betaine detergent surfactants having the general formula:

$$R—\overset{(+)}{N}(R^1)_2—R^2\overset{(-)}{COO}$$

wherein R is a hydrophobic group selected from the group consisting of alkyl groups containing from about 10 to about 22 carbon atoms, preferably from about 12 to about 18 carbon atoms, alkyl aryl and aryl alkyl groups containing a similar number of carbon atoms with a benzene ring being treated as equivalent to about 2 carbon atoms, and similar structures interrupted by amido or ether linkages; each $R^1$ is an alkyl group containing from 1 to about 3 carbon atoms; and $R^2$ is an alkylene group containing from 1 to about 6 carbon atoms.

Examples of preferred betaines are dodecyl dimethyl betaine, cetyl dimethyl betaine, dodecyl amidopropyldimethyl betaine, tetradecyldimethyl betaine, tetradecylamidopropyldimethyl betaine, and dodecyldimethylammonium hexanoate.

Other suitable amidoalkylbetaines are disclosed in U.S. Pat. Nos. 3,950,417; 4,137,191; and 4,375,421; and British Patent GB No. 2,103,236, all of which are incorporated herein by reference.

It will be recognized that the alkyl (and acyl) groups for the above betaine surfactants can be derived from either natural or synthetic sources e.g., they can be derived from naturally occurring fatty acids; olefins such as those prepared by Ziegler, or Oxo processes; or from olefins separated from petroleum either with or without "cracking".

The ethylene oxide condensates are broadly defined as compounds produced by the condensation of ethylene oxide groups (hydrophilic in nature) with an organic hydrophobic compound, which can be aliphatic or alkyl aromatic in nature. The length of the hydrophilic or polyoxyalkylene radical which is condensed with any particular hydrophobic group can be readily adjusted to yield a water-soluble compound having the desired balance between hydrophilic and hydrophobic elements.

Examples of such ethylene oxide condensates suitable as suds stabilizers are the condensation products of aliphatic alcohols with ethylene oxide. The alkyl chain of the aliphatic alcohol can either be straight or branched and generally contains from about 8 to about 18, preferably from about 8 to about 14, carbon atoms for best performance as suds stabilizers, the ethylene oxide being present in amounts of from about 8 moles to about 30, preferably from about 8 to about 14 moles of ethylene oxide per mole of alcohol.

Examples of the amide surfactants useful herein include the ammonia, monoethanol, and diethanol amides of fatty acids having an acyl moiety containing from about 8 to about 18 carbon atoms and represented by the general formula:

$$R_1—CO—N(H)_{m-1}(R_2OH)_{3-m}$$

wherein R is a saturated or unsaturated, aliphatic hydrocarbon radical having from about 7 to 21, preferably from about 11 to 17 carbon atoms; $R_2$ represents a methylene or ethylene group; and m is 1, 2, or 3, preferably 1. Specific examples of said amides are mono-ethanol amine coconut fatty acid amide and diethanol amine dodecyl fatty acid amide. These acyl moieties may be derived from naturally occurring glycerides, e.g., coconut oil, palm oil, soybean oil, and tallow, but can be derived synthetically, e.g., by the oxidation of petroleum or by hydrogenation of carbon monoxide by the Fischer-Tropsch process. The monoethanol amides and diethanolamides of $C_{12-14}$ fatty acids are preferred.

Amine oxide semi-polar nonionic surfactants comprise compounds and mixtures of compounds having the formula

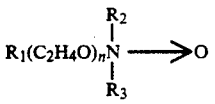

wherein $R_1$ is an alkyl, 2-hydroxyalkyl, 3-hydroxyalkyl, or 3-alkoxy-2-hydroxypropyl radical in which the alkyl and alkoxy, respectively, contain from about 8 to about 18 carbon atoms, $R_2$ and $R_3$ are each methyl, ethyl, propyl, isopropyl, 2-hydroxyethyl, 2-hydroxypropyl, or 3-hydroxypropyl, and n is from 0 to about 10. Particularly preferred are amine oxides of the formula:

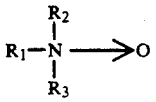

wherein $R_1$ is a $C_{12-16}$ alkyl and $R_2$ and $R_3$ are methyl or ethyl. The above ethylene oxide condensates, amides, and amine oxides are more fully described in U.S. Pat. No. 4,316,824 (Pancheri), incorporated herein by reference.

the composition of this invention can also contain certain cationic quarternary ammonium surfactants of the formula:

$$[R^1(OR^2)_y][R^3(OR^2)_y]_2R^4N^+X^-$$

or amine surfactants of the formula:

$$[R^1(OR^2)_y][R^3(OR^2)_y]R^4N$$

wherein $R^1$ is an alkyl or an alkyl benzyl group having from about 6 to about 16 carbon atoms in the alkyl chain; each $R^2$ is selected from the group consisting of $—CH_2CH_2—$, $—CH_2CH(CH_3)—$, $—CH_2CH(CH_2OH)—$, $—CH_2CH_2CH_2—$, and mixtures thereof; each $R^3$ is selected from the group consisting of $C_1$–$C_4$ alkyl, $C_1$–$C_4$ hydroxyalkyl, benzyl, and hydrogen when y is not 0; $R^4$ is the same as $R^3$ or is an alkyl chain wherein the total number of carbon atoms of $R^1$ plus $R^4$ is from about 8 to about 16; each y is from 0 to about 10, and the sum of the y values is from 0 to about 15; and X is any compatible anion.

Preferred of the above are the alkyl quaternary ammonium surfactants, especially the mono-long chain alkyl surfactants described in the above formula when $R^4$ is selected from the same groups as $R^3$. The most preferred quaternary ammonium surfactants are the chloride, bromide, and methylsulfate $C_{8-16}$ alkyl trimethylammonium salts, $C_{8-16}$ alkyl di(hydroxyethyl)-methylammonium salts, the $C_{8-16}$ alkyl hydroxyethyldimethylammonium salts, $C_{8-16}$ alkyloxpropyl trimethylammonium salts, and the $C_{8-16}$ alkyloxypropyl dihydroxyethylmethylammonium salts. Of the above, the $C_{10-14}$ alkyl trimethylammonium salts are preferred, e.g., decyl trimethylammonium methylsulfate, lauryl trimethylammonium chloride, myristyl trimethylammonium bromide and coconut trimethylammonium chloride, and methylsulfate.

The suds boosters used in the compositions of this invention can contain any one or mixture of the suds boosters listed above.

Additional Optional Ingredients

In addition to the ingredients described hereinbefore, the compositions can contain other conventional ingredients suitable for use in liquid or gel dishwashing compositions.

Optional ingredients include drainage promoting ethoxylated nonionic surfactants of the type disclosed in U.S. Pat. No. 4,316,824, Pancheri (Feb. 23, 1982), incorporated herein by reference.

Others include detergency builders, either of the organic or inorganic type. Examples of water-soluble inorganic builders which can be used, alone or in admixture with themselves or with organic alkaline sequestrant builder salts, are alkali metal carbonates, phosphates, polyphosphates, and silicates. Specific examples of such salts are sodium tripolyphosphate, sodium carbonate, potassium carbonate, sodium pyrophosphate, potassium pyrophosphate, potassium tripolyphosphate, and sodium hexametaphosphate. Examples of organic builder salts which can be used alone, or in admixture with each other or with the preceding inorganic alkaline builder salts, are alkali metal polycarboxylates, e.g., water-soluble citrates such as sodium and potassium citrate, sodium and potassium tartrate, sodium and potassium ethylenediaminetetraacetate, sodium and potassium N-(2-hydroxyethyl)-ethylene diamine triacetates, sodium and potassium nitrilo triacetates (NTA), sodium and potassium N-(2-hydroxyethyl)-nitrilo diacetates, sodium and potassium oxydisuccinates, and sodium and potassium tartrate mono- and di-succinates, such as described in U.S. Pat. No. 4,663,071 (Bush et al., issued May 5, 1987), incorporated herein by reference. Other organic detergency builders such as water-soluble phosphonates can find use in the compositions of the invention. In general, however, detergency builders have limited value in dishwashing detergent compositions, and use at levels above about 10% can restrict formulation flexibility in the liquid or gel compositions herein because of solubility and phase stability considerations.

Alcohols, such as ethyl alcohol and propylene glycol, and hydrotropes, such as sodium and potassium toluene sulfonate, sodium and potassium xylene sulfonate, trisodium sulfosuccinate, and related compounds (as disclosed in U.S. Pat. No. 3,915,903, incorporated herein by reference), and urea, can be utilized in the interests of achieving a desired product phase stability and viscosity. Alcohols such as ethyl alcohol and propylene glycol at a level of from 0% to about 15%, potassium or sodium toluene, xylene, or cumene sulfonate at a level of from 0% to about 10%, urea at a level of from 0% to about 10%, and trisodium sulfosuccinate at a level of from 0% to about 15% are particularly useful in the liquid compositions of the invention.

Gel compositions of the invention normally would not contain alcohols. These gel compositions may contain higher levels of potassium or sodium toluene, xylene, or cumene sulfonate, and urea at higher levels, i.e., from about 10% to about 30%, as gelling agents (see U.S. Pat. No. 4,615,819 and GB 2,179,054A).

Other desirable ingredients include diluents and solvents. Diluents can be inorganic salts, such as sodium sulfate, ammonium chloride, sodium chloride, sodium bicarbonate, etc., and the solvents include water, lower molecular weight alcohols, such as ethyl alcohol, isopropyl alcohol, etc. Compositions herein will typically contain up to about 80%, preferably from about 30% to about 70%, most preferably from about 40% to about 65%, of water.

As used herein, all percentages, parts, and ratios are by weight unless otherwise stated.

The following Examples illustrate the invention and facilitate its understanding.

EXAMPLE I

The following three liquid compositions of the present invention are prepared according to the descriptions set forth below.

Formulation A is made by adding ethanol, sodium chloride, and sodium xylene sulfonate to the alkyl ethoxy carboxylate-containing surfactant mixture. The remaining surfactants are then added and mixed in. Glycine is then added and the pH is adjusted to about 10 with sodium hydroxide. Finally, the magnesium chloride is added, which reduces the pH to about 9.5. Final viscosity and pH adjustments can be made at this time, followed by the addition of perfume and dye. The balance is water.

Formulation B is made by adding ethanol, sodium chloride, and sodium xylene sulfonate to the sodium alkyl ethoxy carboxylate. The remaining formula components are added in the order given in the table.

Formulation C is made by adding ethanol, sodium chloride, and sodium xylene sulfonate to the sodium salt of alkyl ethoxy carboxylate. The alkyl glucoside is mixed in and the temperature of the mixture raised to about 40° C. The coconut monoethanolamine amide is warmed to about 65° C. and mixed in. Minor pH and viscosity adjustments are made at this time, followed by the addition of dye and perfume and water to bring the formulation to 100%.

| | % By Weight | | |
|---|---|---|---|
| Components | Formulation A | Formulation B | Formulation C |
| Sodium $C_{12-13}$ alkyl ethoxy (2.8 ave.) carboxylate* | 15 | 15 | 15 |
| $C_{12-13}$ alkyl ethoxy (2.8 ave.) alcohol* | 0.97 | 0.97 | 0.97 |
| Sodium $C_{12-13}$ alkyl ethoxy (0.8 ave.) sulfate | 15 | — | — |
| Sodium $C_{12-14}$ fatty acid α-sulfonate methyl ester | — | 15 | — |
| $C_{12-13}$ alkyl polyglucoside (1.4 ave.) | — | — | 15 |
| $C_{12-14}$ alkyl dimethyl betaine | 4.0 | — | — |
| $C_{12-14-16}$ alkyl dimethyl amine oxide | — | 4.0 | — |
| $C_{12-14}$ fatty acid monoethanolamine amide | — | — | 4.0 |
| Magnesium ion (added as $MgCl_2.6H_2O$) | 0.76 | 0.76 | — |
| Glycine | 4.0 | — | — |
| Sodium xylene sulfonate | 2.0 | 2.2 | 2.0 |
| Ethanol | 7.5 | 7.0 | 7.0 |
| Sodium chloride | 1.5 | <1 | 2.25 |
| Product pH | 9.5 | 7.55 | 7.05 |
| Perfume and dye | 0.15 | 0.15 | 0.15 |
| Water | Balance | Balance | Balance |

*The surfactant mixture containing sodium alkyl ethoxy carboxylate and alkyl ethoxy alcohol is prepared according to the process outlined below:

1. A $C_{12-13}$ alkyl ethoxy (3.0 ave.) alcohol is reacted with potassium t-butoxide and sodium chloroacetate in the ratio of 1:1.1:1.1 by first mixing the alkyl ethoxylate with the potassium t-butoxide at about 60° C. and about 20 mm Hg pressure for about 1 hour. Hereinafter, t-butanol is continuously removed from the reaction mixture by distillation. Thereafter, the vacuum is broken and sodium chloroacetate is added with mixing. The pressure is reestablished at about 18–20 mm Hg, and the reaction is allowed to continue for about 3 hours. Afterwards, the reaction pressure is brought to atmospheric level with nitrogen, and the steam heating coils are turned off. The reaction is left in this state overnight. The next day the reaction mixture temperature is increased and the pressure reduced to remove more t-butanol from the system. The reaction mixture is then added to an aqueous solution of hydrochloric acid containing 105% of the theoretical amount needed to neutralize the potassium t-butoxide initially added. The acid aqueous reaction product is heated to force phase separation of the organic and aqueous materials. The organic phase is collected.
2. Step 1 above is repeated using a $C_{12-13}$ alkyl ethoxy (2.7 ave.) alcohol and a ratio of this ethoxy alcohol to potassium t-butoxide and sodium chloroacetate of 1:1.3:1.3. The potassium t-butoxide is added to the alkyl ethoxylate, which is at a temperature of about 32.2° C., and the reaction mixture is then increased to about 76.7° C. The vacuum pump is then turned on to achieve reduced pressure. The reaction temperature is increased to about 104.4° C., and the t-butanol is pulled off and collected over about a 30 minute period. The sodium chloroacetate is then added to the reaction mixture, which has been cooled slightly to about 66° C. The reaction is mixed for about 1.5 hours, cooled, and added to an aqueous solution of sufficient hydrochloric acid to achieve a pH of 3.4. Water is added to increase the volume of the reaction mixture by about 50%, and the mixture is the heated to about 49° C. The top organic layer is collected, and the washing process is repeated.

3. The surfactant mixtures produced in Steps 1 and 2 above are mixed at a ratio of 40.4 to 59.6, respectively. A portion of this larger combined surfactant mixture is neutralized with 50% sodium hydroxide to a pH of about 8 and diluted by about 50% with a 25/75 by volume mixture of water and ethanol. The resulting solution is continuously extracted at room temperature with hexanes for about four days. The lower aqueous phase is collected, and some ethanol and water is removed by heating to yield a paste containing the alkyl ethoxy carboxylate containing surfactant mixture described below.

In the above, the surfactant portion of the above mixture contains about 93.9% alkyl ethoxy carboxylates of the formula $RO(CH_2CH_2O)_xCH_2COO^-Na^+$ where R is a $C_{12-13}$ alkyl averaging 12.5; x ranges from 0 to about 10, and the ethoxylate distribution is such that the amount of material where x is 0 is about 2.8% and the amount of material where x is greater than 7 is less than about 2% by weight of the alkyl ethoxy carboxylates. The average x in the distribution is 2.8. The surfactant mixture also contains about 6.1% of alcohol ethoxylates of the formula $RO(CH_2CH_2O)_xH$ with R being a $C_{12-13}$ alkyl averaging 12.5 and the average x=2.8. The surfactant mixture contains 0% soap materials.

The above formulations provide an excellent combination of grease cleaning and mildness benefits. Using the alkyl ethoxy carboxylate containing surfactant mixture as a building block, a range of good grease cleaning is achieved with the rank order being Formulation A >Formulation B >Formulation C. These same formulations provide a range of mildness benefits with the rank order being Formulation C >formulation B >Formulation A.

EXAMPLE II

The liquid formulations in Example I can also be successfully made by replacing the alkyl ethoxy carboxylate-containing surfactant mixture with a surfactant mixture (described below) prepared via an oxidation process wherein alcohol ethoxylates are reacted with oxygen in the presence of a noble metal catalyst as is disclosed generally in U.S. Pat. Nos. 4,223,460; 4,214,101; and 4,348,509; and German Pat. No. 3,446,561; and Japanese Patent Application No. 62,198,641. The surfactant mixture comprises 92.4% alkyl ethoxy carboxylates of the formula $RO(CH_2CH_wO)_xCH_2COO^-Na^+$ wherein R is a $C_{12-14}$ alkyl averaging 12.7 with x ranging from 0 to about 12. In the ethoxylate distribution, the weight % of the component x=0 is about 10%, and the amount of the materials with x greater than 7 is less than about 3% by weight. The average x in the distribution is 2.5. The surfactant mixture also contains about 6.4% of alcohol ethoxylates of the formula $RO(CH_2CH_2O)_xH$ with R being a $C_{12-14}$ alkyl averaging 12.7 and the average x is about 3.7. In addition, the surfactant mixture contains about 1.2% by weight of soaps of the formula $RCOO^-Na^+$ wherein R is $C_{11-13}$ averaging $C_{11.7}$. This formulation would contain 15% by weight of the alkyl ethoxy carboxylates, 1.04% by weight of alcohol ethoxylates, and 0.2% by weight of soaps. The other components in the formulations are identical. Minor modifications in the ethanol and the sodium xylene sulfonate levels may be made to adjust the viscosity and stability of the formulation to match the formulations of Example I.

These formulations give approximately the same grease cleaning and mildness benefits as seen in Example I.

EXAMPLE III

The following liquid formulation containing the surfactant mixture used in Example I comprising the same alkyl ethoxy carboxylates provides exceptional grease cleaning and hand mildness, with sudsing somewhat less than Formulations A, B, and C.

| Components | Formulation D (Wt. %) |
|---|---|
| Sodium $C_{12-13}$ alkyl ethoxy (2.8 ave.) carboxylate | 28 |
| $C_{12-13}$ alkyl ethoxy (2.8 ave.) alcohol | 1.8 |
| Magnesium ion (added as $MgCl_2.6H_2O$) | 0.6 |
| Glycine | 4.0 |
| Sodium xylene sulfonate | 2.0 |
| Ethanol | 7.5 |
| Sodium chloride | 1.5 |
| Product pH | 9.0 |
| Perfume and dye | 0.15 |
| Water | Balance |

EXAMPLE IV

A gel composition of the present invention can be prepared using the general method described in U.S. Pat. No. 4,615,819. The composition contains 35.0% by weight sodium $C_{12-14}$ alkyl ethoxy (3.0 ave.) carboxylate and 2.3% by weight $C_{12-14}$alkyl ethoxy (3.0 ave.) alcohol. If urea is used as the gelling "additive", the pH of a 10% by weight aqueous solution should be kept below about 8.0 in order to prevent ammonia smell in the composition, which results from decomposition of the urea.

This gel composition has good grease cutting ability and excellent hand mildness properties as compared to current available gel compositions (e.g., U.S. Pat. No. 4,615,819).

EXAMPLE V

The following three liquid compositions of the present invention are prepared according to the method as set forth below.

Ethanol is added to the acid-form of the alkyl ethoxy carboxylate mixture. Then a slight excess over the stoichiometric amount of sodium hydroxide needed to neutralize the acid is added and mixed in. Following neutralization, alkyl sulfate, cumene sulfonate, trisodium sulfosuccinate, betaine, and amine oxide are added if called for. The appropriate buffering agents (glycine and/or tris(hydroxymethyl)aminomethane) are then added as an aqueous solution at or, in the cases of Formulations X and Y, slightly above the target pH of the composition. If called for in the formulation, magnesium chloride is added at this time to the mixture having a pH of between 9.5 and 10. If the magnesium is added to a mixture having a pH greater than about 10, precipitation of the magnesium can occur. Finally, perfume and dye are added, the viscosity is adjusted using ethanol, and water is added to complete the formula.

| Components | % By Weight | | |
|---|---|---|---|
| | Formulation X | Formulation Y | Formulation Z |
| Sodium $C_{12-13}$ alkyl ethoxy (3.5 ave.) carboxylate* | 30 | 22 | 24 |
| $C_{12-13}$ alkyl ethoxy (3.5 ave.) alcohol* | 1.8 | 1.3 | 1.5 |
| Sodium $C_{12-13}$ alkyl sulfate | — | 6.0 | 4.0 |
| $C_{12-14-16}$ alkyl dimethyl amine oxide | 2.0 | 3.0 | 3.0 |
| $C_{12-14}$ alkyl amidopropyl dimethyl betaine | 2.0 | 3.0 | 3.0 |
| Magnesium ion (added as $MgCl_2.6H_2O$) | 0.6 | 0.76 | — |
| Glycine | 4.0 | 4.0 | — |
| Tris(hydroxymethyl)-aminomethane | 3.3 | 3.3 | 4.0 |
| Sodium cumene sulfonate | 5.0 | — | — |
| Trisodium sulfosuccinate | — | 4.5 | 4.5 |
| Sodium chloride | <2 | <2 | <2 |
| Ethanol | 7.5 | 7.5 | 7.5 |
| Product pH | 9.3 | 9.3 | 8.9 |
| Perfume and dye | 0.15 | 0.15 | 0.15 |
| Water | Balance | Balance | Balance |

*The surfactant mixture containing sodium alkyl ethoxy carboxylates and alcohol ethoxylate is prepared by neutralizing the acid form of the alkyl ethoxy carboxylate mixture with sodium hydroxide. After neutralization, the surfactant portion of the mixture contains about 94.3% alkyl ethoxy carboxylates of the formula $RO(CH_2CH_2O)_xCH_2COO^-Na^+$ where R is a $C_{12-13}$ alkyl averaging 12.5, x ranges from 0 to about 10, and the ethoxylate distribution is such that the amount of material where x is 0 is about 0.5% and the amount of material where x is greater than 7 is less than about 6% by weight of the alkyl ethoxy carboxylates. The average x in the distribution is 3.5. The surfactant mixture also contains about 5.7% of alcohol ethoxylates of the formula $RO(CH_2CH_2O)_xH$ with R being a $C_{12-13}$ alkyl averaging 12.5 and the average x is 3.5. The surfactant mixture contains 0% soap materials.

The above formulations provide an excellent combination of grease cleaning and mildness benefits. Using the alkyl ethoxy carboxylate containing surfactant mixture as a building block, a range of good grease cleaning is achieved with rank order being Formulation X >Formulation Y >>Formulation Z. These same formulations provide both a range of mildness benefits with the rank order being Formulation X >Formulation Z >Formulation Y and a range of sudsing benefits with the rank order being Formulation Y >Formulation Z >>Formulation X.

What is claimed is:

1. A light duty liquid or gel dishwashing detergent composition comprising by weight from about 5% to about 70% of an alkyl ethoxy carboxylate mixture comprising form about 80% to about 100% of alkyl ethoxy carboxylates of the formula:

$$RO(CH_2CH_2O)_xCH_2COO^-M^+$$

wherein R is a $C_{12}$ to $C_{16}$ alkyl group, x ranges from 0 to about 10 and the ethoxylate distribution is such that, on a weight basis, the amount of material where x is 0 is less than about 20% and the amount of material where x is greater than 7 s less than about 25%, the average x is from about 2 to 4 when the average R is $C_{13}$ or less, and the average x is from about 3 to 6 when the average R is greater than $C_{13}$ and M is a cation; said alkyl ethoxy carboxylate mixture containing less than about 10% of alcohol ethoxylates of the formula:

$$RO(CH_2CH_2O)_xH$$

wherein R is a $C_{12}$ to $C_{16}$ alkyl group and x ranges from 0 to about 10 and the average x is less than about 6, and less than about 10% of soaps of the formula:

$$RCOO^-M^+$$

wherein R is a $C_{11}$ to $C_{15}$ alkyl group and M is a cation; wherein a 10% by weight aqueous solution of said composition has a pH from about 7 to 11.

2. The composition of claim 1 wherein the pH is from about 8 to 10.5.

3. The composition of claim 2 wherein the pH is from about 8.5 to 10.

4. The composition of claim 1 wherein from 0% to about 1.5% of magnesium ions are present and the pH is from about 7 to 9.5.

5. The composition of claim 4 wherein from about 0.3% to 0.8% of magnesium ions are present.

6. The composition of claim 1 wherein the cation "M" of said alkyl ethoxy carboxylate is potassium or sodium; the pH is from about 8.5 to 9.5; and from about 0.3 to 0.8% of magnesium ions are present.

7. The composition of claim 1 further comprising from 0% to about 35% of a co-surfactant selected from the group consisting of alkyl benzene sulfonates, alkyl sulfates, paraffin sulfonates, olefin sulfonates, alkyl ether sulfates, fatty acid ester sulfonates, alkyl polyglucosides, and mixtures thereof.

8. The composition of claim 1 further comprising from 0% to about 15% of a suds booster selected from the group consisting of betaines, ethylene oxide condensates, fatty acid amides, amine oxide semi-polar nonionics, cationic surfactants, and mixtures thereof.

9. The composition of claim 7 further comprising from 0% to about 15% of a suds booster selected from betaines, ethylene oxide condensates, fatty acid amides, amine oxide semi-polar nonionics, cationic surfactants, and mixtures thereof.

10. The composition of claim 9 wherein the pH is from about 8 to 10.5.

11. The composition of claim 9 wherein from about 0.3% to 0.8% of magnesium ions are present.

12. The composition of claim 9 wherein the pH is from about 8.5 to 9.5 and from about 0.3% to 0.8% of magnesium ions are present.

13. The composition of claim 1 wherein R in (a) is a $C_{12}$ to $C_{14}$ alkyl group.

14. A liquid composition of claim 1 comprising from about 12% to 30% of the surfactant mixture.

15. The composition of claim 1 wherein the surfactant mixture comprises from about 85% to 95% of the alkyl ethoxy carboxylates.

16. The composition of claim 15 wherein the surfactant mixture comprises from about 90% to 95% of the alkyl ethoxy carboxylates.

17. The composition of claim 13 wherein the surfactant mixture comprises from about 85% to 95% of the alkyl ethoxy carboxylates.

18. The composition of claim 17 wherein the surfactant mixture comprises from about 90% to 95% of the alkyl ethoxy carboxylates.

19. The composition of claim 1 wherein the surfactant mixture comprises less than about 8% of the alcohol ethoxylates.

20. The composition of claim 19 wherein the surfactant mixture comprises less than about 5% of the alcohol ethoxylates.

21. The composition of claim 1 wherein the surfactant mixture comprises less than about 5% of the soaps.

22. The composition of claim 13 wherein the surfactant mixture comprises from about 90% to 95% alkyl ethoxy carboxylates, less than about 5% alcohol ethoxylates, and less than 5% soaps.

23. The composition of claim 22 wherein the pH is from about 7 to 9.5 and from 0% to about 1.5% of magnesium ions are present.

24. The composition of claim 23 wherein the pH is from about 8.5 to 9.5 and from about 0.3% to about 0.8% of magnesium ions are present.

25. The composition of claim 22 further comprising from 0% to about 35% of a co-surfactant selected from the group consisting of alkyl ether sulfates, fatty acid ester sulfonates, alkyl sulfates, alkyl polyglucosides, and mixtures thereof.

26. The composition of claim 22 further comprising from 0% to about 15% of a suds booster selected from the group consisting of betaines, amine oxide semi-polar nonionics, fatty acid amides, and mixtures thereof.

27. The composition of claim 26 further comprising from 0% to about 35% of a co-surfactant selected from the group consisting of alkyl ether sulfates, fatty acid ester sulfonates, alkyl polyglucosides, and mixtures thereof, wherein from 0% to about 1.5% of magnesium ions are present and the pH is from about 7 to 9.5.

28. A gel composition of claim 1 comprising from about 28% to 35% of the surfactant mixture.

* * * * *

UNITED STATES PATENT AND TRADEMARK OFFICE

CERTIFICATE OF CORRECTION

PATENT NO. : 5,230,823

DATED : July 27, 1993

INVENTOR(S) : RODNEY M. WILSE, THOMAS A. CRIPE

It is certified that error appears in the above-indentified patent and that said Letters Patent is hereby corrected as shown below:

Column 15, line 68
"x is greater than 7 s" should read -- x is greater than 7 is -- .

Column 16, line 4
"...less than about 10% of" should read -- ...less than about 8% of -- .

Column 16, line 5
"alcohol ethoxylates of the formula:" should read
-- fatty alcohols and alcohol ethoxylates of the formula: -- .

Signed and Sealed this

Twenty-fourth Day of May, 1994

Bruce Lehman

*Attest:*

BRUCE LEHMAN

*Attesting Officer*

*Commissioner of Patents and Trademarks*